United States Patent [19]

Hobby, Jr.

[11] 3,947,025

[45] Mar. 30, 1976

[54] ARM WRESTLING UNIT

[76] Inventor: John M. Hobby, Jr., 1463 Jeffwood, Pontiac, Mich. 48054

[22] Filed: Nov. 8, 1974

[21] Appl. No.: 521,959

[52] U.S. Cl. ..... 272/83 R
[51] Int. Cl.² ..... A63B 23/00
[58] Field of Search ..... 272/83 R, 67, 82; 16/85

[56] References Cited

UNITED STATES PATENTS

| | | | |
|---|---|---|---|
| 1,232,000 | 7/1917 | Chase | 16/85 |
| 2,223,309 | 11/1940 | Swanson | 272/83 R |
| 3,180,666 | 4/1965 | Jorgensen | 16/85 X |
| 3,451,675 | 6/1969 | Burzenski | 272/83 R |
| 3,563,542 | 2/1971 | Wellman et al. | 272/83 R |

*Primary Examiner*—Paul E. Shapiro
*Attorney, Agent, or Firm*—Farley, Forster and Farley

[57] ABSTRACT

An "arm wrestling" exercise device comprising; a helical coiled spring with a hand extension and adjustably mounted in a sleeve between a pair of brackets on a base providing for elbow engagement and arm deflection of the spring to a "down" position. The sleeve is angularly adjustable to accommodate the user's arm length and the spring is axially adjustable within its sleeve retainer to vary the number of active coils and thereby the stiffness and force required to deflect the spring. Such adjustment together with a series of calibrated coiled springs provide for continuous adjustment of stiffness from minimum to maximum.

7 Claims, 7 Drawing Figures

ARM WRESTLING UNIT

BACKGROUND OF THE INVENTION

Numerous approaches have been made with various constructions for arm exercising and strength testing devices such as those disclosed in the following U.S. patents:

| | |
|---|---|
| 1,189,396 | Sheridan |
| 3,428,311 | Mitchell |
| 3,467,376 | Feinberg |
| 3,563,542 | Wellman et al |
| 3,633,907 | Cane et al |
| 3,662,602 | Weiss |
| 3,713,653 | Romans |
| 3,815,904 | Weiss et al |

Some of these employ an elongated rigid member; others employ a plurality of springs interconnecting a reference plate to a handle. However, all of such prior art constructions are relatively complicated and none to the best of applicant's knowledge employs an adjustable helical spring and sleeve mounting wherein the arm force is directly absorbed by bending a simple coiled spring.

SUMMARY OF THE INVENTION

Applicant has provided an extremely simple "arm wrestling" exercise device wherein the opponent's arm is simulated by a close wound heavy duty helical spring having a handle extension and mounted in a close fitting tubular sleeve which provides adjustment both with respect to the angle of the coiled spring relative to an elbow rest base as well as to the length of the active spring coils extending from the sleeve mounting which determines the effective stiffness and force required to move the handle to a down position on the base. The stiffness increases inversely with the length of the active coils projecting from the sleeve and for any given setting of the projecting coil and handle length the angle of the mounting may be adjusted to accommodate the length of the user's arm. By employing a series of spring coils with handle extensions having a common outer diameter but with progressively heavier wire section, a continuous adjustment in force required to deflect the spring handle to a down position may be provided ranging from a minimum children's weight to a maximum adult's required arm force.

IN THE DRAWINGS

DESCRIPTION

Figure 1:
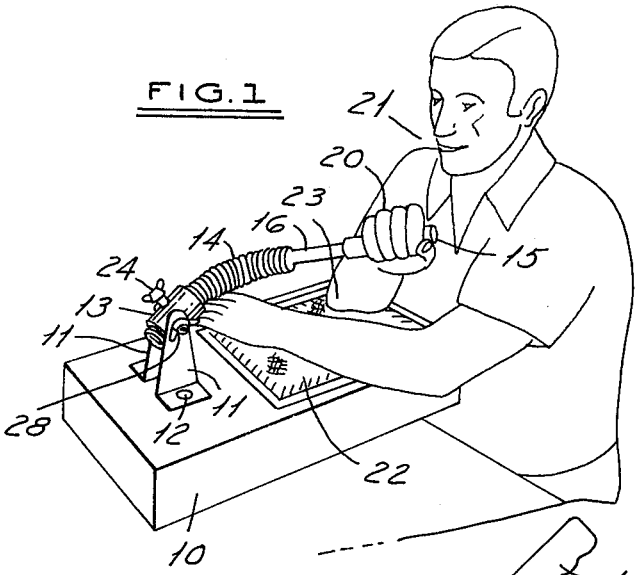
FIG. 1 is a perspective view of the device in use with a helical coiled spring in a partially deflected condition.
Figure 4:
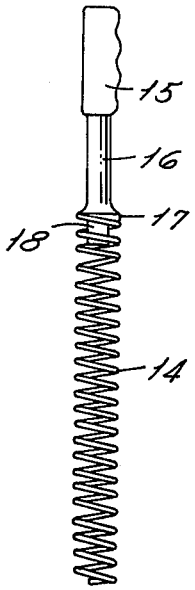
FIG. 4 is a side elevation of an auxilliary spring and handle extension assembly employing a helical coiled spring having equal outer diameter to that illustrated in FIG. 2 but employing a wire diameter of lighter strength rendering the spring more readily deflected with less force than that shown in FIG. 2.
Figure 2:
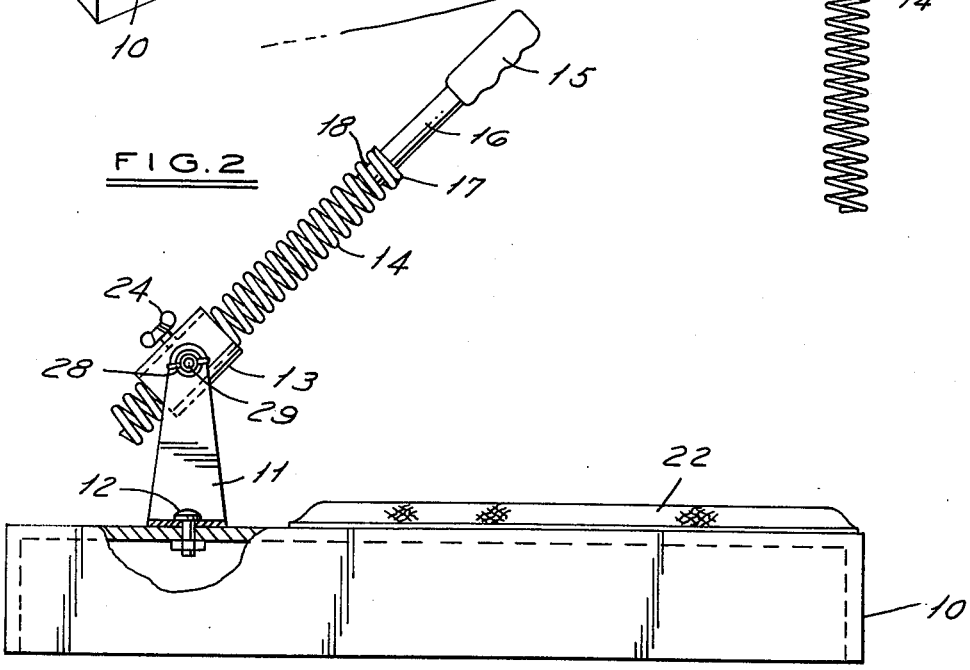
FIG. 2 is a side elevation of the assembled device.
Figure 3:
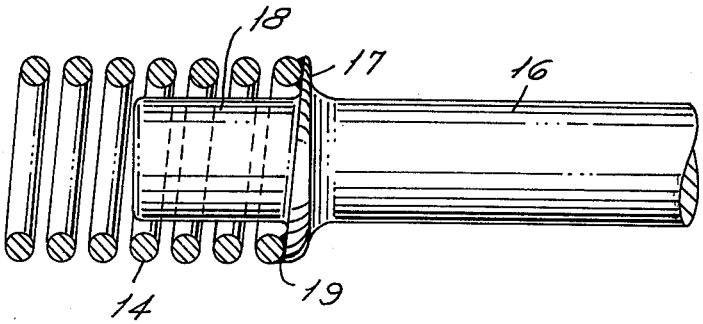
FIG. 3 is an enlarged fragmentary sectional view illustrating the connection between the coiled spring and handle extension.
Figure 5:
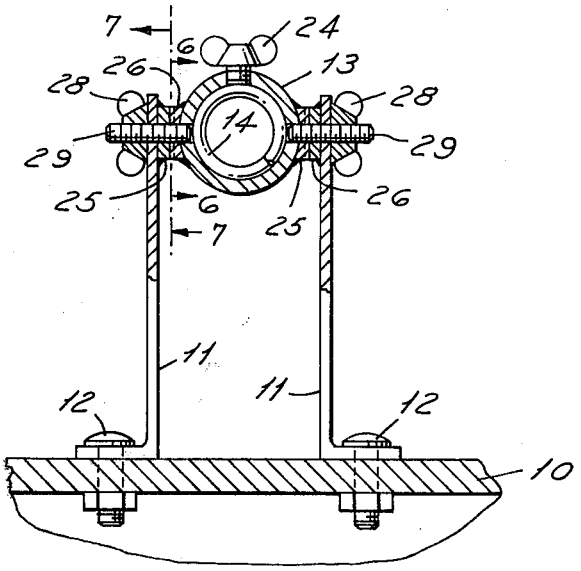
FIG. 5 is a fragmentary sectional end view of the bracket sleeve and coiled spring assembly showing the respective adjustment elements.

Referring to FIGS. 1, 2 and 5 the exercise device comprises a base 10 on which a pair of angle brackets 11 are anchored by bolts 12 within the upper ends of which is mounted a tubular sleeve 13 providing a close fit for a heavy duty coiled spring 14 to the outer end of which a handle 15 extension 16 with collar 17 is welded as best shown in FIG. 3. An inner end 18 of the extension projects within the coiled spring a short distance to provide a lateral support for the spring under deflection so as to relieve the welded connection 19 of the need for resisting the entire bending force applied at the inner connection. Handle 15 is provided with a suitable resilient grip material for a hand 20 of the user 21 and a resilient pad 22 is provided for the user's elbow 23 extending over a sufficient area to accommodate both children's and adult's use.

A wing headed screw 24 at the top of the sleeve 13 provides means for holding coiled spring 14 in an adjusted position. This does not require any appreciable holding force when the device is in use since the spring within the close fitting sleeve binds under deflection.

Figure 6:
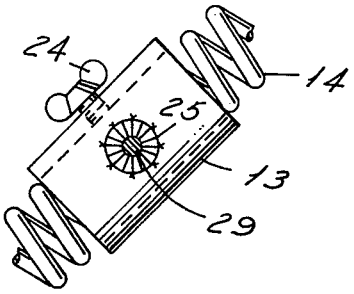
FIG. 6 is a fragmentary sectional view taken along the line 6—6 of FIG. 5.
Figure 7:
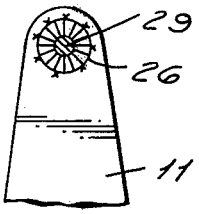
FIG. 7 is a fragmentary view of the bracket taken along the line 7—7 of FIG. 5.

Sleeve 13 is welded to the outside of a pair of serrated bosses 25, as best shown in FIG. 6, which are adapted to engage opposed matching serrated bosses 26 welded to the inner upper ends of the brackets 11 and a pair of threaded studs 27 anchored in and projecting from the sleeve 13 extend through clearance holes in the respective serrated bosses. These are engaged by a pair of threaded wing nuts 38 which serve to tighten the serrated bosses in any adjusted relative anchored position as required to provide the sleeve and spring arm extension appropriate to the arm length of the user.

In using the device, respective wing headed screw 24 and wing nuts 28 are loosened, a spring arm of appropriate strength is selected and inserted to a position providing desired rigidity whereupon the wing screw 24 is tightened and the sleeve angle adjusted to position the handle 50 at a height appropriate to the user's length of arm at which level the wing nuts 27 are tightened.

I claim:

1. An arm wrestling testing and exercise device comprising a base, a tubular sleeve mounted to said base at an oblique angle thereto, a helical coil spring with an extension handle projecting from one end thereof and engaging said sleeve at the other end thereof, and an elbow rest on said base under said handle.

2. The device of claim 1 including means for axial adjustment of the spring within said tubular sleeve to vary the effective length and stiffness of the projecting active coils.

3. The device of claim 2 including a retaining screw for holding the coiled spring in adjusted position within the tubular sleeve.

4. The device of claim 1 including bracket means anchored to said base and means for adjusting the angle of said sleeve relative to said bracket means.

5. The device of claim 4 wherein said adjustment means comprise mating serrated boss elements on said bracket means and sleeve adapted to interengage in adjusted position, and means for clamping said boss elements in adjusted position.

6. The device of claim 1 including a plurality of interchangeable helical spring coil and extension arm assemblies, each spring having a common outside diameter adapted to closely fit said sleeve but having different spring coil cross sections to provide different resistance to bending.

7. The device of claim 6 wherein said interchangeable coils are calibrated to provide continuous adjustment of required bending force to reach a predetermined deflection over the combined range of said interchangeable spring coils.

* * * * *